US010039363B2

(12) United States Patent
Miller

(10) Patent No.: US 10,039,363 B2
(45) Date of Patent: Aug. 7, 2018

(54) MULTI-PHASE COSMETIC COMPOSITION MIXING PACK

(71) Applicant: L'Oreal, Paris (FR)

(72) Inventor: Zane Bowman Allen Miller, Seattle, WA (US)

(73) Assignee: L'Oreal, Paris (FR)

( * ) Notice: Subject to any disclaimer, the term of this patent is extended or adjusted under 35 U.S.C. 154(b) by 73 days.

(21) Appl. No.: 15/144,649

(22) Filed: May 2, 2016

(65) Prior Publication Data

US 2017/0311698 A1 Nov. 2, 2017

(51) Int. Cl.

| | |
|---|---|
| ***A45D 34/04*** | (2006.01) |
| ***B01F 11/00*** | (2006.01) |
| ***B01F 15/00*** | (2006.01) |

(52) U.S. Cl.

CPC ..... *A45D 34/048* (2013.01); *B01F 11/0088* (2013.01); *B01F 11/0091* (2013.01); *B01F 11/0097* (2013.01); *B01F 15/00467* (2013.01); *B01F 15/00506* (2013.01); *A45D 34/043* (2013.01); *A45D 34/045* (2013.01); *A45D 2200/058* (2013.01); *B01F 2215/0031* (2013.01)

(58) Field of Classification Search

CPC combination set(s) only.
See application file for complete search history.

(56) References Cited

U.S. PATENT DOCUMENTS

| | | | |
|---|---|---|---|
| 2,631,826 | A | 3/1953 | Wolf |
| 2,904,808 | A | 9/1959 | Massman |
| 3,115,664 | A | 12/1963 | Del Ponte |
| 3,336,624 | A | 8/1967 | Schefer et al. |
| 4,984,918 | A | 1/1991 | Lizuka et al. |

(Continued)

FOREIGN PATENT DOCUMENTS

| | | | |
|---|---|---|---|
| DE | 10 2005 037 633 | A1 | 2/2007 |
| EP | 0 465 278 | A1 | 1/1992 |

(Continued)

OTHER PUBLICATIONS

International Search Report and Written Opinion of the International Searching Authority dated Jul. 7, 2017, issued in corresponding International Application No. PCT/US2017/029438, filed Apr. 25, 2017, 15 pages.

*Primary Examiner* — David Walczak
(74) *Attorney, Agent, or Firm* — Christensen O'Connor Johnson Kindness PLLC

(57) ABSTRACT

A multi-phase cosmetic composition mixing pack for mixing immiscible components of a multi-phase cosmetic composition such that they are temporarily miscible includes a container for holding the multi-phase cosmetic composition that has a first open end. The mixing pack further includes a mixing assembly disposed within the container for mixing immiscible components of the multi-phase cosmetic composition such that they are temporarily miscible, and an actuator assembly for actuating the mixing assembly. The actuator assembly comprises a stem receivable within the first open end of the container. The stem includes a cam surface extending along at least a portion of a length of the stem, and a cam follower surface defined on the mixing assembly, wherein linear reciprocating motion of the stem causes rotation of the mixing assembly.

19 Claims, 12 Drawing Sheets

(56) References Cited

U.S. PATENT DOCUMENTS

| | | | | | |
|---|---|---|---|---|---|
| 5,172,992 | A | * | 12/1992 | Ackermann | A45D 34/048 401/129 |
| 5,192,153 | A | | 3/1993 | Gueret | |
| 5,700,100 | A | * | 12/1997 | Ackermann | A45D 40/267 401/122 |
| 6,615,881 | B2 | | 9/2003 | Bartholomew et al. | |
| 7,785,574 | B2 | | 8/2010 | Bobka et al. | |
| 7,931,140 | B2 | | 4/2011 | Heidenreiter | |
| 2004/0247373 | A1 | | 12/2004 | Gueret | |
| 2014/0314464 | A1 | | 10/2014 | Huang | |

FOREIGN PATENT DOCUMENTS

| | | | |
|---|---|---|---|
| WO | 2007/060438 | A2 | 5/2007 |
| WO | 2014/107023 | A1 | 7/2014 |

* cited by examiner

MULTI-PHASE COSMETIC COMPOSITION MIXING PACK

SUMMARY

In one embodiment, a multi-phase cosmetic composition mixing pack for mixing immiscible components of a multi-phase cosmetic composition such that they are temporarily miscible includes a container for holding the multi-phase cosmetic composition that has a first open end. The mixing pack further includes a mixing assembly disposed within the container for mixing immiscible components of the multi-phase cosmetic composition such that they are temporarily miscible, and an actuator assembly for actuating the mixing assembly. The actuator assembly comprises a stem receivable within the first open end of the container. The stem includes a cam surface extending along at least a portion of a length of the stem, and a cam follower surface defined on the mixing assembly, wherein linear reciprocating motion of the stem causes rotation of the mixing assembly.

In another embodiment, a multi-phase cosmetic composition mixing pack for mixing immiscible components of a multi-phase cosmetic composition such that they are temporarily miscible includes a container for holding the multi-phase cosmetic composition that has a first open end. The mixing pack further includes a mixing assembly disposed within the container for mixing immiscible components of the multi-phase cosmetic composition such that they are temporarily miscible. The mixing assembly comprises an auger having at least one helix extending between first and second points of rotation, wherein the auger is comprised of at least one of a hydrophilic material and a hydrophobic material. The mixing pack further includes an actuator assembly for actuating the mixing assembly that includes a stem receivable within the first open end of the container, the stem having a cam surface extending along at least a portion of a length of the stem, and a cam follower surface defined on the mixing assembly, wherein linear reciprocating motion of the stem causes rotation of the mixing assembly.

In yet another embodiment, a method for mixing a multi-phase cosmetic composition mixing having immiscible components such that they are temporarily miscible includes providing a mixing pack having a container for holding the multi-phase cosmetic composition with a first open end. The mixing pack further includes a mixing assembly disposed within the container and an actuator assembly for actuating the mixing assembly. The actuator assembly includes a stem receivable within the first open end of the container, wherein the stem has a cam surface extending along at least a portion of a length of the stem, and a cam follower surface defined on the mixing assembly. The method further includes reciprocating the stem linearly within the container to rotate the mixing assembly to mix the immiscible components of the multi-phase cosmetic composition such that they are temporarily miscible.

In yet another embodiment, a multi-phase cosmetic composition mixing pack for mixing immiscible components of a multi-phase cosmetic composition such that they are temporarily miscible includes a container for holding the multi-phase cosmetic composition that has a first open end. The mixing pack further includes a mixing assembly disposed within the container for mixing immiscible components of the multi-phase cosmetic composition such that they are temporarily miscible, and an actuator assembly for actuating the mixing assembly. The actuator assembly comprises a motor having a drive shaft, wherein the drive shaft is engageable with the mixing assembly.

In yet another embodiment, a multi-phase cosmetic composition mixing pack for mixing immiscible components of a multi-phase cosmetic composition such that they are temporarily miscible includes a container for holding the multi-phase cosmetic composition that has a first open end. The mixing pack further includes a mixing assembly disposed within the container for mixing immiscible components of the multi-phase cosmetic composition such that they are temporarily miscible, and an actuator assembly for actuating the mixing assembly. The actuator assembly comprises a hand crank assembly operatively coupled to the mixing assembly. In another aspect, the hand crank assembly is defined by a cap securable to the container, a hand crank extending from an upper portion of the cap, and a crank block extending from a bottom portion of the cap that is engageable with the mixing assembly to rotate the mixing assembly in at least a first direction.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
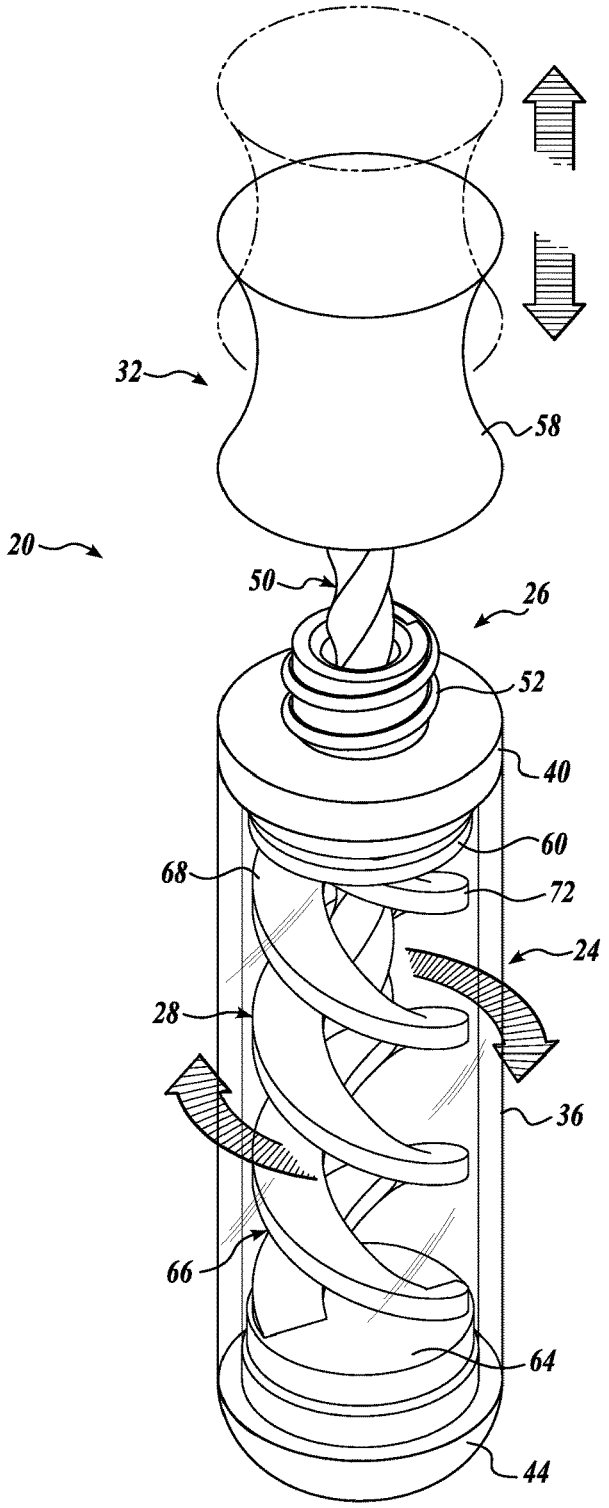
FIG. 1 is an isometric view of a multi-phase cosmetic composition mixing pack formed in accordance with a first exemplary embodiment of the present disclosure.

Many cosmetic compositions, including pigmented cosmetics such as foundations and lipsticks, have been formulated in an attempt to possess long wearing properties upon application. Unfortunately, many of these compositions do not generally possess both good long-wear/transfer-resistance properties as well as good application properties, good comfort properties and/or good appearance properties (for example, shine, gloss or matte properties).

For example, with respect to lip products, commercial products containing silicon resins such as MQ resins are known. Such products are known to provide good long wear properties and/or transfer-resistance. However, such products possess poor application properties, poor feel upon application (for example, feel rough) and poor shine or gloss properties owing to the film formed by the MQ resin (for example, a matte appearance). Therefore, a second composition (topcoat) is separately applied to such products to improve poor properties of the compositions to make the products acceptable to consumers. Furthermore, the topcoat composition must be reapplied continually so that the product remains acceptable to consumers, meaning that the products are effectively not "long-wearing" as they require constant maintenance and reapplication.

Also, with respect to foundations, such products can provide good long wear properties and/or transfer-resistance. However, such long-wearing/transfer-resistant products can possess poor application and/or feel upon properties application, as well as poor matte properties.

"Single step" multi-phase cosmetic compositions having improved cosmetic properties, particularly good wear, feel, shine, gloss and/or matte characteristics upon application are described in U.S. patent application Ser. No. 15/144,716, entitled "Lip Compositions," filed on May 2, 2016, with the inventor Rita El-Khouri, U.S. patent application Ser. No. 15/144,622, entitled "Liquid Lipstick Compositions Capable of Forming a Multilayer Structure After Application to Lips," filed on May 2, 2016, with the inventor Rita El-Khouri, U.S. patent application Ser. No. 15/144,698 entitled "Lip Compositions Capable of Forming a Multilayer Structure After Application to Lips," filed on May 2, 2016, with the inventor Rita El-Khouri, and U.S. Provisional Patent Application No. 62/316,309, entitled "Cosmetic Compositions Capable of Forming a Multilayer Structure After Application to a Keratinous Material," filed on Mar. 31, 2016, with the inventor Rita El-Khouri, the disclosures of which are incorporated by reference herein in their entirety. The above-referenced applications disclose, for example, a multi-phase cosmetic composition for keratinous materials (for example, skin, hair, eyelashes, nails or lips) which has good cosmetic properties such as, for example, good adhesion, transfer-resistance, feel, gloss (or shine), and/or matte upon application, and which can be applied to a keratinous material without having to engage in a multi-step application process. More specifically, the above-referenced applications disclose multi-phase cosmetic compositions that comprise at least two immiscible components prior to application and that are capable of forming a multilayer structure after application to a keratinous material. Such multi-phase cosmetic compositions allow for benefits associated with multilayer cosmetic products without having to engage in a multi-step application process.

Immiscibility of the immiscible components can result from an incompatibility between the two components when the composition is at rest, an incompatibility between the two components after application to a keratinous material, or both. When the immiscible components result from an incompatibility between the two components when the composition is at rest, i.e., in a cosmetic container, the immiscible components must be appropriately mixed prior to application of the multi-phase cosmetic composition to the keratinous material. Once appropriately mixed, the multi-phase cosmetic composition comprising the temporarily miscible components can be applied to the keratinous material. Subsequent to application to the keratinous material, the components separate to form a multilayer structure on the keratinous material.

The present invention relates to a multi-phase cosmetic composition mixing pack that can be used for mixing the multi-phase cosmetic composition so that the immiscible components are temporarily miscible. For purposes of this detailed description, the term "mixing" (or like versions, such as "mix" or "mixed") shall be interpreted to include any suitable mixing, blending, churning, emulsifying, etc., of the multi-phase cosmetic composition so that the immiscible components are temporarily miscible.

The detailed description set forth below in connection with the appended drawings is intended as a description of exemplary embodiments of the multi-phase cosmetic composition mixing pack and are not intended to represent the only embodiments. The representative embodiments described in this disclosure are provided merely as an example or illustration and are not intended to be exhaustive or to limit the claimed subject matter to the precise forms disclosed.

In the following description, numerous specific details are set forth in order to provide a thorough understanding of the exemplary embodiments of the present disclosure. It will be apparent to one skilled in the art, however, that the exemplary embodiments of the present disclosure may be practiced without some or all of the specific details. In some instances, well-known process steps or features have not been described in detail in order not to unnecessarily obscure various aspects of the present disclosure. Further, it will be appreciated that the exemplary embodiments of the present disclosure may employ any combination of features described herein.

The present application may include references to directions, such as "forward," "rearward," "front," "back," "upward," "downward," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

Turning now to FIG. 1, there is shown a first exemplary embodiment of a multi-phase cosmetic composition mixing pack 20 ("mixing pack 20") suitable for mixing a multi-phase cosmetic composition (not shown) so that the immiscible components are temporarily miscible. The mixing pack 20 generally includes a container 24 for holding the multi-phase cosmetic composition, a mixing assembly 28 for mixing the multi-phase cosmetic composition, an actuation assembly 26 for actuating the mixing assembly 28, and an applicator 32 for applying the temporarily miscible components of the multi-phase cosmetic composition to a keratinous material.

Figure 2:
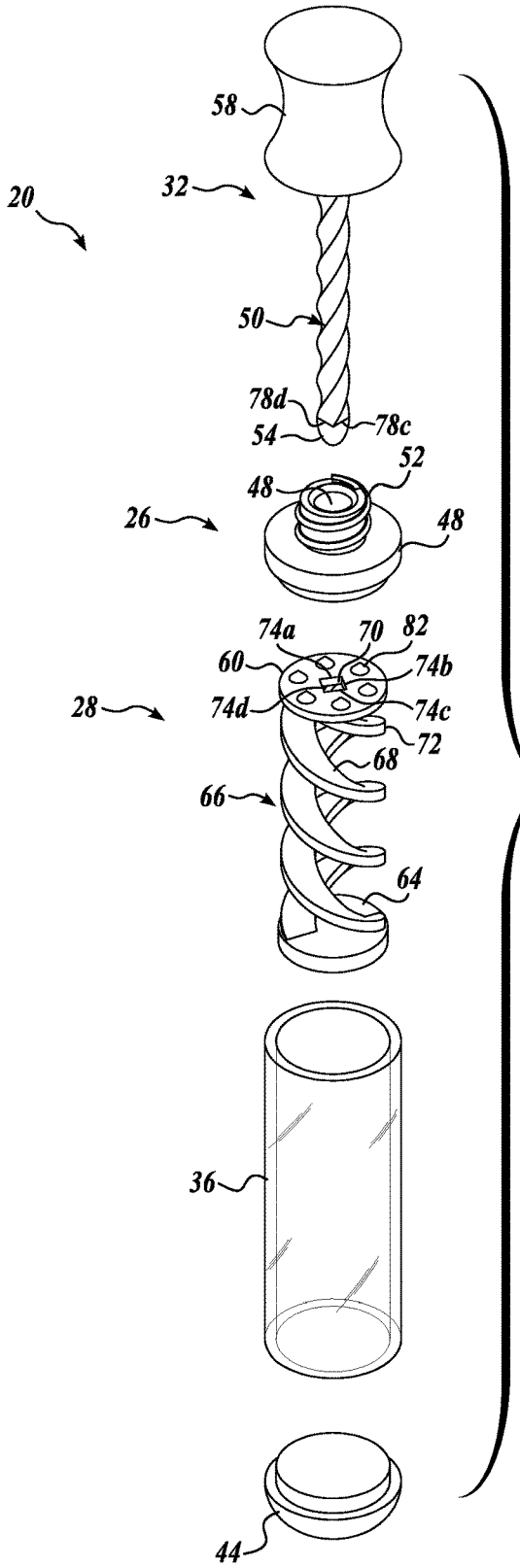
FIG. 2 is a top isometric exploded view of the multi-phase cosmetic composition mixing pack of FIG. 1.
Figure 3:
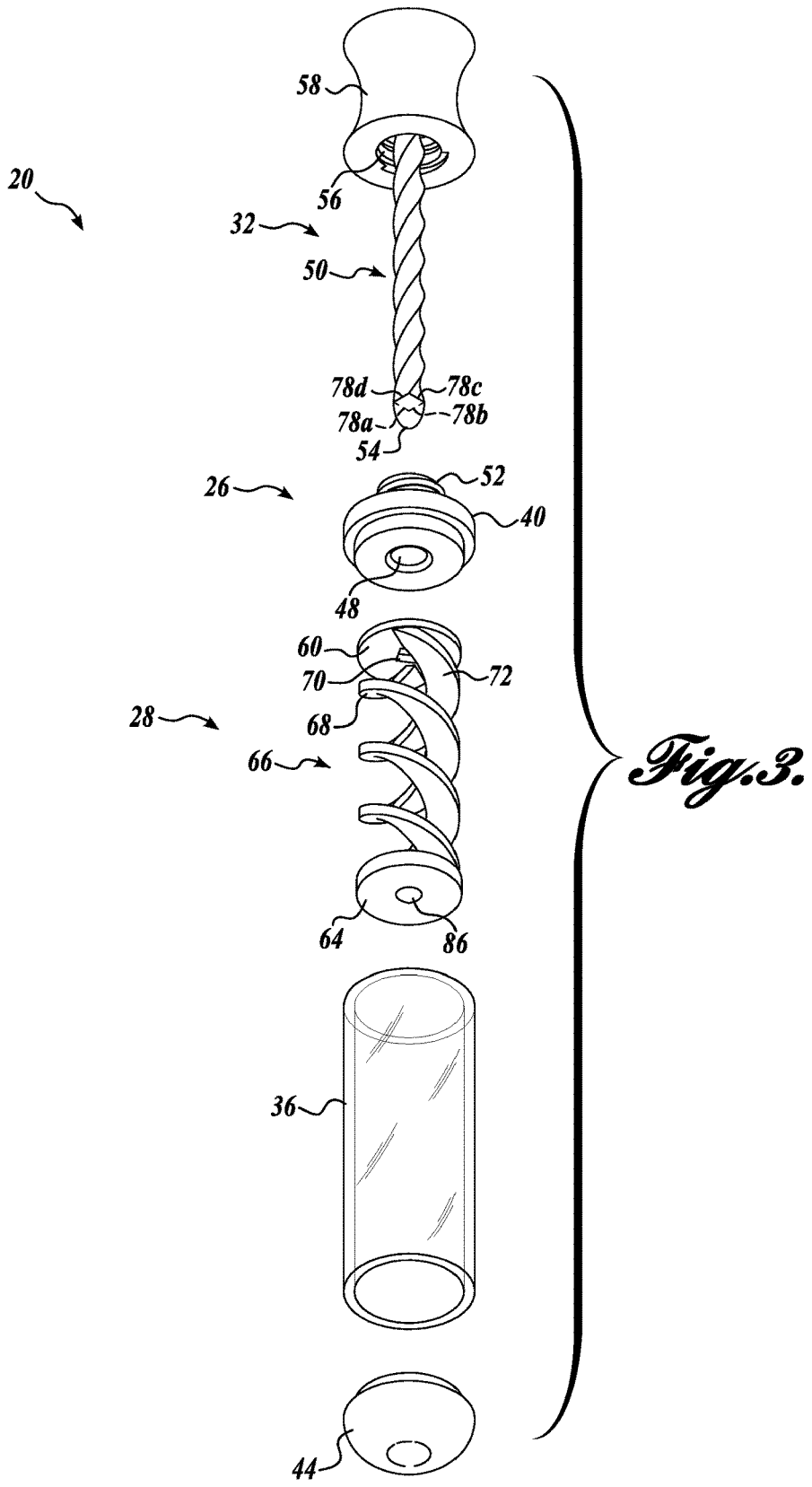
FIG. 3 is a bottom isometric exploded view of the multi-phase cosmetic composition mixing pack of FIG. 1.

Referring to FIGS. 1-3, the container 24 will first be described in detail. The container 24 may be any suitable shape, size, configuration, material, etc., to appropriately hold a desired multi-phase cosmetic composition. In the depicted embodiment, the container 24 includes a substantially cylindrically-shaped glass or plastic container body 36, having first and second open ends that are enclosed by first and second end caps 40 and 44. The first and second (or top and bottom) end caps 40 and 44 may be press-fit or otherwise secured to or within the open ends of the container body 36 in any suitable manner.

The second (or bottom) end cap 44 encloses and seals the second, bottom open end of the container body 36, and the first (or top) end cap 40 encloses and seals the first, top open end of the container body 36 and provides an interface between the applicator 32 and the interior of the container 24, in that regard, the first end cap 40 includes a central opening 48 extending from a top surface to a bottom surface of the first end cap 40.

The central opening 48 is sized to allow a mixing stem 50 of the applicator 32 to pass therethrough. The central opening 48 is also surrounded by a threaded collar 52 extending upwardly from the top surface of the first end cap 40 that is engageable with internal threads 56 in a cap 58 of the applicator 32. The mixing stem 50, which extends from an interior portion of the cap 58, is encircled by the internal threads 56. As such, when the internal threads 56 are threaded onto the threaded collar 52 of the container 24, the mixing stem 50 passes through the central opening 48 and extends into the container body 36. In that regard, an applicator portion or tip 54 defined on a distal end of the mixing stem 50 is positionable within the interior of the container body 36 to withdraw the multi-phase cosmetic composition for application to a keratinous material. Any other suitable mating configuration between the applicator 32 and the container 24 may instead be used.

It should be appreciated that the container 24 may instead be comprised of a container body that is integrally formed with first and second end caps 40 and 44. Moreover, the container body 36 and the first and second end caps 40 and 44 may be formed from any suitable material in any suitable manner. For instance, the container body 36 and first and second end caps 40 and 44 may be integrally or separately formed by injection molding. Any other suitable container configuration may instead be used to suit the intended use, for example, lip gloss, foundation, etc.

The container 24 is suitably sized and shaped to enclose the mixing assembly 28 (or the mixing assembly 28 is sized to fit within the container 24) such that when the mixing assembly 28 is actuated by the actuation assembly 26, the multi-phase cosmetic composition contained within the container 24 is appropriately mixed. The mixing assembly 28 includes an auger 66 defined by at least one helix extending between an upper motion transfer plate 60, a first point of rotation for the auger 66, and a lower base plate 64, a second point of rotation for the auger 66. The nominal diameter of the auger 66 defined by the at least one helix is substantially the same size as an interior diameter of the container body 36. As such, the auger 66 reaches substantially all the contents of the container 24 when actuated to ensure substantially even mixing of the immiscible components.

In the depicted embodiment, the auger 66 includes a first helix 68 of a predefined geometry extending between the upper motion transfer plate 60 and the lower base plate 64. The mixing assembly 28 further includes a second helix 72 extending between the upper motion transfer plate 60 and the lower base plate 64 that is substantially identical in geometry to the first helix 68 and offset from the first helix 68 by about one hundred and eighty degrees (180°).

In that regard, any suitable helix geometry (pitch, diameter, shape, etc.) may be used for the intended application. For instance, a low viscosity multi-phase cosmetic composition may be sufficiently mixed with a lower pitch helix design, wherein a higher viscosity multi-phase cosmetic composition may require a higher pitch helix design to sufficiently mix the immiscible components. It can be appreciated that the auger geometry will be dependent on the intended application of the mixing pack 20. Accordingly, the descriptions and illustrations provided herein should not be seen as limiting.

The auger 66 is actuated by the actuation assembly 26 to mix the multi-phase cosmetic composition. The actuation assembly 26 is defined by the mixing stem 50 of the applicator 32, which interfaces with the motion transfer plate 60 to rotate the auger 66 about its central longitudinal axis. The mixing stem 50 and the motion transfer plate 60 define a cam and follower mechanism that is configured to translate linear reciprocating motion of the applicator 32 to rotary motion of the auger 66.

Although any suitable cam and follower mechanism may be used, in the depicted embodiment, the motion transfer plate 60 includes a central opening 70 that is substantially square shaped to define first, second, third, and fourth cam follower edges or surfaces 74*a*-74*d*. The substantially square-shaped central opening 70 is sized and shaped to receive the mixing stem 50 of the applicator 32, where the mixing stem 50 is substantially square-shaped in cross-section, but twisted along its length. In that regard, the mixing stem 50 includes first second, third, and fourth cam surfaces 78*a*-78*d* that extend axially along its length in a twisted manner. The first, second, third, and fourth cam surfaces 78*a*-78*d* of the mixing stem 50 are engageable with the first, second, third, and fourth cam follower edges or surfaces 74*a*-74*d* of the motion transfer plate 60 as the mixing stem 50 is reciprocating linearly into and out of the container 24.

Figure 4A:
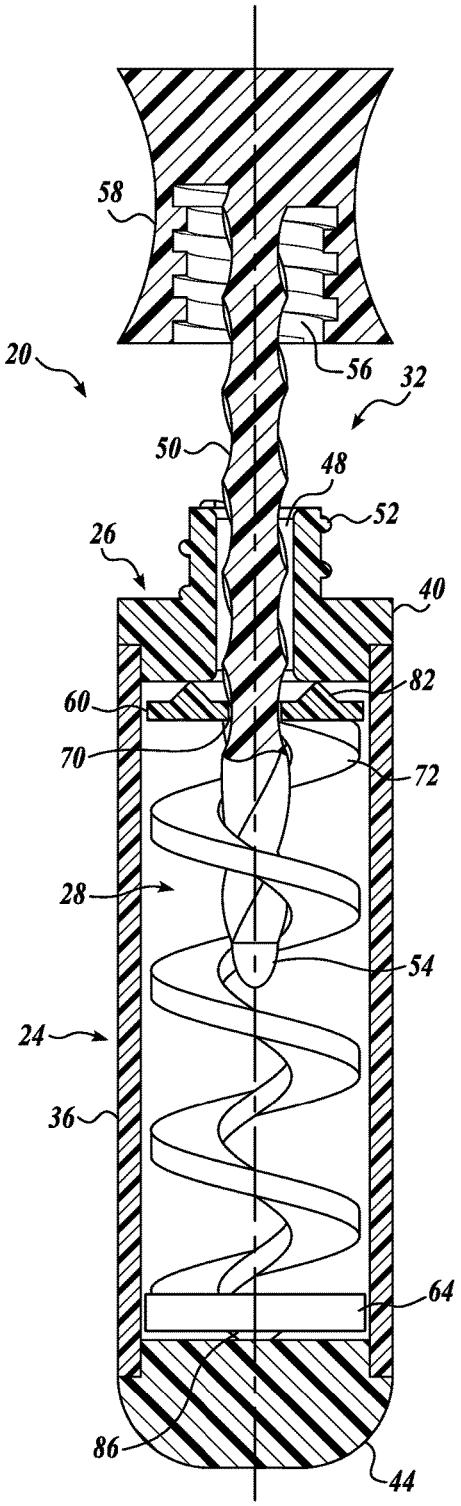
FIG. 4*a* is a partial cross-sectional view of the multi-phase cosmetic composition mixing pack of FIG. 1, wherein a portion of the mixing pack is shown in a first position.
Figure 4B:
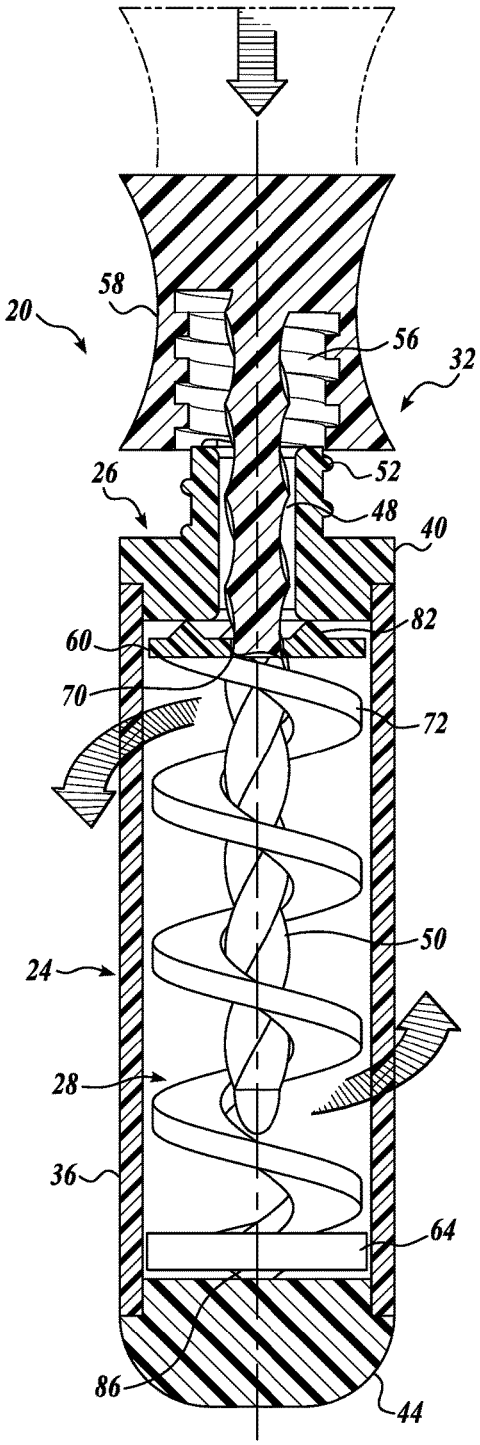
FIG. 4*b* is a partial cross-sectional view of the multi-phase cosmetic composition mixing pack of FIG. 1, wherein a portion of the mixing pack is shown in a second position.

More specifically, and referring additionally to FIGS. 4*a*-4*b*, as the mixing stem 50 is reciprocated linearly, the first, second, third, and fourth cam follower edges or surfaces 74*a*-74*d* of the motion transfer plate 60 engage and follow the twisted track defined by each of the first, second, third, and fourth cam surfaces 78*a*-78*d* of the mixing stem 50, respectively. For instance, when the mixing stem 50 is moved in a first linear direction (e.g., downwardly), as shown in FIG. 4*b*, the motion transfer plate 60 is rotated in a first rotational direction (e.g., counterclockwise), thereby rotating the auger 66 in the first rotational direction (e.g., counterclockwise). When the mixing stem 50 is moved in a second linear direction opposite the first linear direction (e.g., upwardly), the motion transfer plate 60 is rotated in a second rotational direction (e.g., clockwise) opposite the first rotational direction, thereby rotating the auger 66 in the second rotational direction (e.g., clockwise). Accordingly, as the mixing stem 50 is moved between first and second linear directions, the auger 66 is rotated in first and second rotational directions. In effect, the reciprocating, linear movement of the mixing stem 50 translates to oscillating movement of the auger 66.

As can be appreciated, the mixing stem 50 is a driver member that translates motion to the auger 66 through the motion transfer plate 60, a driven member. The mixing stem 50 is driven by a user applying a sufficient axial force on the cap 58 of the applicator 32. Thus, the mixing stem 50 of the applicator 32 is employed by a user to both activate the auger 66 for mixing the multi-phase cosmetic composition (having immiscible components) and withdrawing the mixed multi-phase cosmetic composition (when the immiscible components are temporarily miscible) for application to the keratinous material.

The mixing assembly 28 may include bearing members or surfaces defined between the mixing assembly 28 and the container 24 for providing a surface against which the mixing assembly 28 may rotate/oscillate, and for reducing the friction between the mixing assembly 28 and the container 24. Although any suitable structure may be used, in the depicted embodiment, the mixing assembly 28 includes a plurality of pointed protrusions 82 (not all labeled) defined on the top surface of the motion transfer plate 60. The pointed protrusions 82 surround the central opening 70 in a spaced, substantially even manner to provide a balanced bearing structure between the top end of the mixing assembly 28 and the first end cap 40.

The pointed protrusions 82 are engageable at their pointed ends with the bottom, interior surface of the first end cap 40. More specifically, the pointed ends of the pointed protrusions 82 engage and follow along the bottom surface of the first end cap 40 as the mixing assembly 28 rotates. The minimal bearing surfaces of the pointed protrusions 82 (compared to the large top surface of the motion transfer plate 60) allows the mixing assembly 28 to easily rotate against the first end cap 40 with little friction.

The mixing assembly 28 also includes a substantially centered rounded protrusion 86 extending from a bottom surface of the auger base 64 that is engageable with an interior surface of the second end cap 44. The small bearing surface of the rounded protrusion 86 (compared to the larger bottom surface of the auger base 64) allows the mixing assembly 28 to easily rotate against the second end cap 44.

Figure 5:
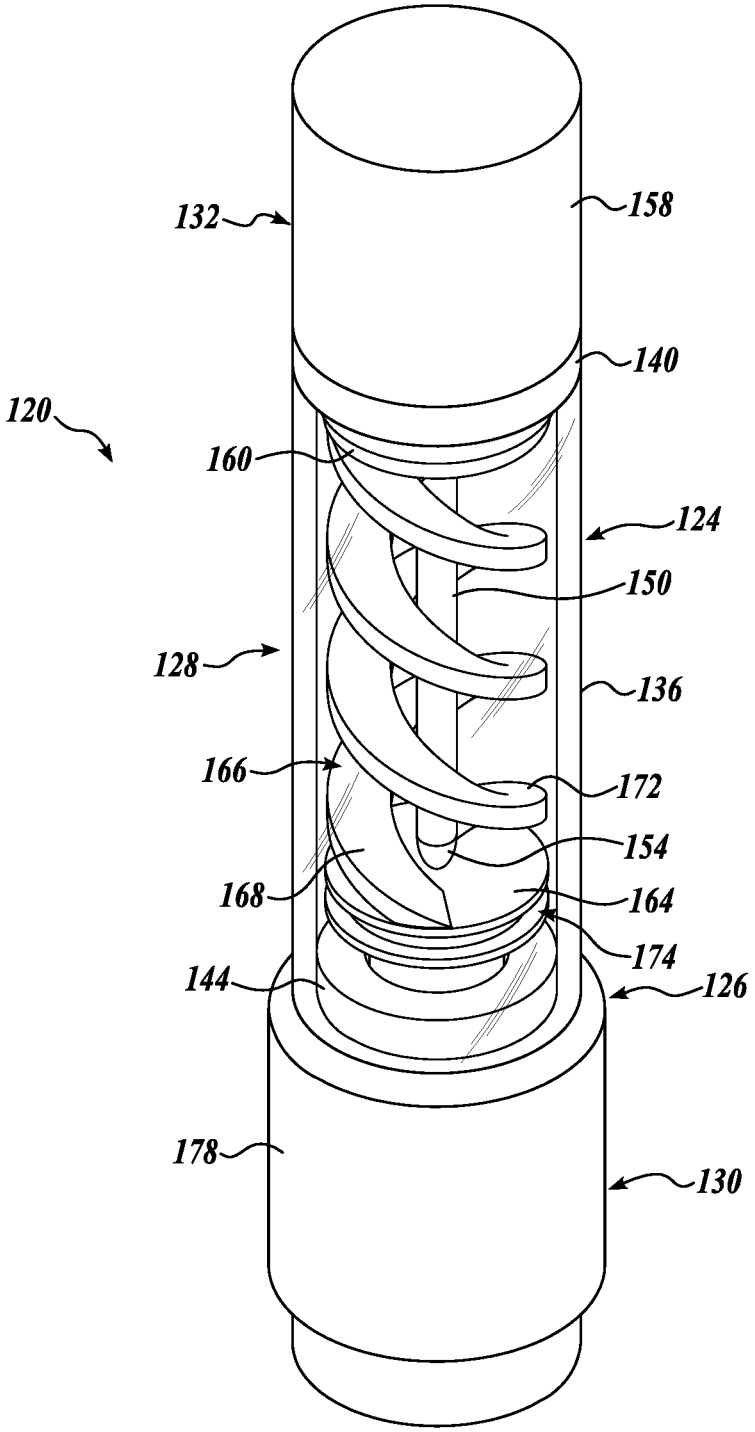
FIG. 5 is an isometric view of a multi-phase cosmetic composition mixing pack formed in accordance with a second exemplary embodiment of the present disclosure.

Referring now to FIG. 5, a second exemplary embodiment of a multi-phase cosmetic composition mixing pack 120 ("mixing pack 120") suitable for mixing a multi-phase cosmetic composition (not shown) so that the immiscible components are temporarily miscible will now be described. The mixing pack 120 is substantially similar in many respects to the mixing pack 20 shown and described with reference to FIGS. 1-4. As such, like parts have been numbered with like references numerals in the '100 series. Aspects of the mixing pack 120 that are substantially identical to the mixing pack 20 will not be described in great detail.

The mixing pack 120 generally includes a container 124 for holding the multi-phase cosmetic composition, a mixing assembly 128 for mixing the multi-phase cosmetic composition, an actuation assembly 126 (defined by a motor assembly 130) for actuating the mixing assembly 128, and an applicator 132 for applying the temporarily miscible components of the multi-phase cosmetic composition to a keratinous material.

Figure 6:
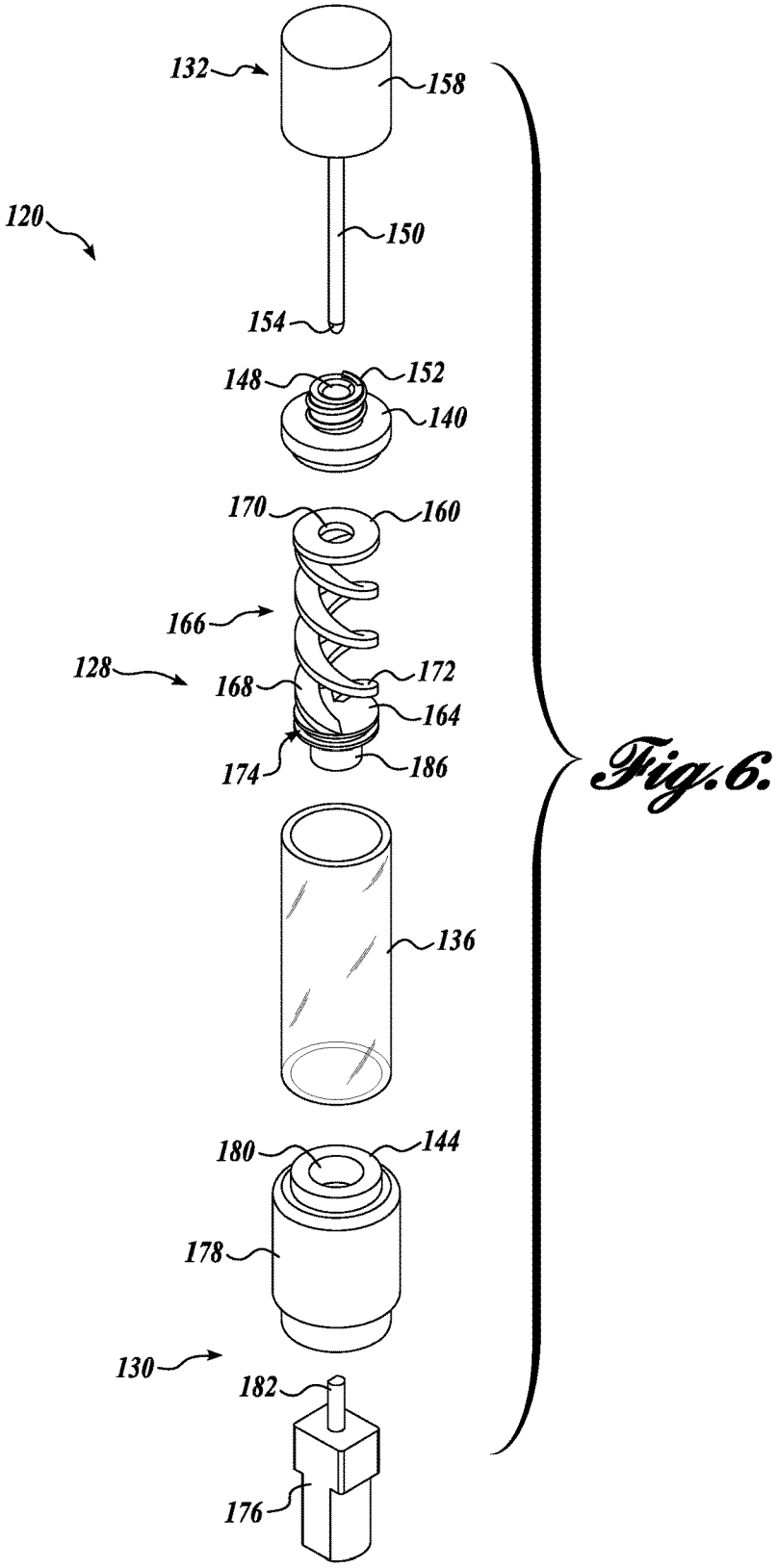
FIG. 6 is a top isometric exploded view of the multi-phase cosmetic composition mixing pack of FIG. 5.
Figure 7:
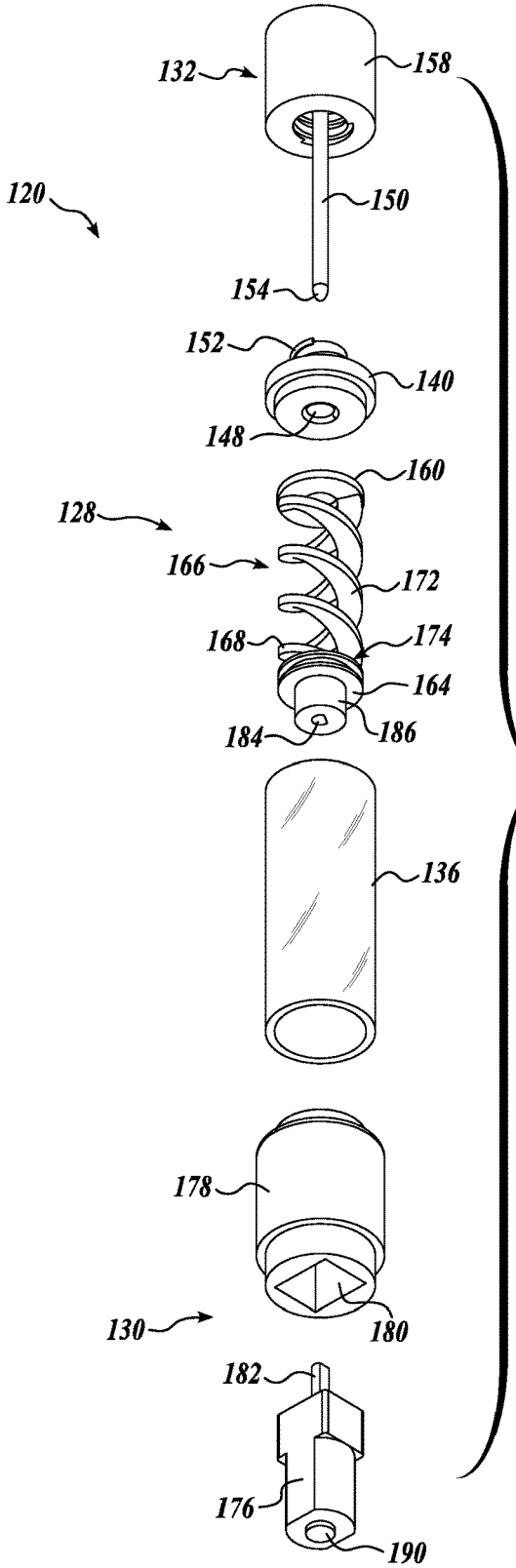
FIG. 7 is a bottom isometric exploded view of the multi-phase cosmetic composition mixing pack of FIG. 5.
Figure 8:
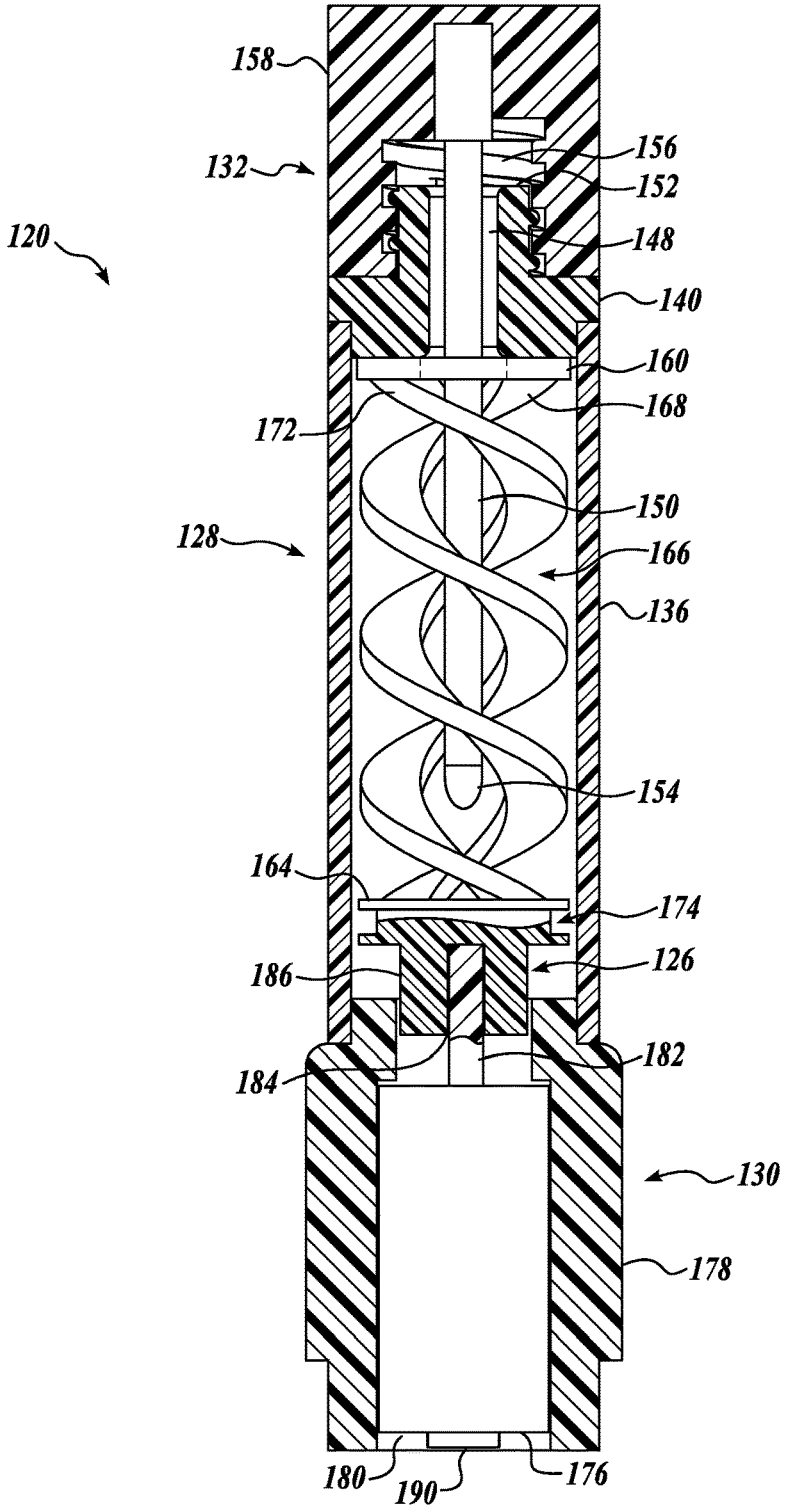
FIG. 8 is a partial cross-sectional view of the multi-phase cosmetic composition mixing pack of FIG. 5.

Referring additionally to FIGS. 6-8, the container 124 has a container body 136 with first and second open ends that are enclosed by first and second (or top and bottom) end caps 140 and 144. The first (or top) end cap 140 is substantially identical to the first end cap 40 described above. In that regard, the first end cap 140 encloses and seals the first, top open end of the container body 136 and provides an interface between the applicator 132 and the interior of the container 124. Similar to the first end cap 40, the first end cap 140 includes a central opening 148 that is sized to allow a stem 150 and applicator tip 154 of the applicator 132 to pass therethrough. The central opening 148 is also surrounded by a threaded collar 152 extending upwardly from the top surface of the first end cap 140 that is engageable with internal threads 156 in a cap 158 of the applicator 132.

The second (or bottom) end cap 144 is defined in part by the motor assembly 130. More specifically, a portion of the motor assembly 130 defines the second end cap 144, which encloses and seals the second, bottom open end of the container body 136. The first and second end caps 140 and 144 may be press-fit or otherwise secured to or within the open ends of the container body 136 in any suitable manner. In the alternative, the container 124 may instead be integrally formed with the end caps. Moreover, any other suitable end caps, mating configurations, and/or container shapes may instead be used for the intended application.

The container 124 is suitably sized and shaped to enclose the mixing assembly 128 (or the mixing assembly 128 is sized to fit within the container 124) such that when the mixing assembly 128 is actuated, the multi-phase cosmetic composition contained within the container 124 is appropriately mixed. The mixing assembly 128 includes an auger 166 defined by at least one helix extending between an upper base plate 160, a first point of rotation for the auger 166, and a lower motion transfer plate 164, a second point of rotation for the auger 166. The lower motion transfer plate 164 may include an annular groove section 174 having one or more annular grooves extending around the circumference of the plate 164. Each annular groove of the annular groove section 174 is configured to receive an annular seal, such as an O-ring (not shown), for sealing between the lower motion transfer plate 164 and the container body 136.

The nominal diameter of the auger 166 defined by the at least one helix is substantially the same size as an interior diameter of the container body 136. As such, the auger 166 reaches substantially all the contents of the container 124 when actuated to ensure substantially even mixing of the immiscible components. In the depicted embodiment, the mixing assembly 128 includes a first helix 168 of a predefined geometry extending between the upper base plate 160 and the lower motion transfer plate 164. The mixing assembly 128 further includes a second helix 172 extending between the upper base plate 160 and the lower motion transfer plate 164 that is substantially identical in geometry to the first helix 168 and offset from the first helix 168 by about one hundred and eighty degrees (180°). The helix geometry of the auger 166 is substantially identical to the helix geometry of the auger 66 described above. However, as noted above, any suitable helix geometry (pitch, diameter, shape, etc.) may be used for the intended application.

The auger 66 is actuated by the motor assembly 130 to mix the multi-phase cosmetic composition. The auger 66 is actuated, or rotated about its central longitudinal axis, when the motor assembly 130 is activated to rotate the lower motion transfer plate 164.

As can best be seen by referring to FIGS. 6-8, the motor assembly 130 includes a motor 176 disposed within a motor housing 178. The motor housing 178 includes an axial opening 180 that is keyed to receive the motor 176 such that the motor 176 is securely retained within the housing 178 when activated. A drive shaft 182 extends from an upper end of the motor 176 and is configured to be received within a keyed opening 184 in a motor engagement protrusion 186 extending from a bottom surface of the motion transfer plate 164. The motor engagement protrusion 186 may be substantially circular in cross-section and receivable within a circular portion of the axial opening 180 in the upper end of the motor housing 178. In this manner, the motor housing 178 acts as a base in which the auger 166 (through the motor engagement protrusion 186) may rotate.

When the motor 176 is activated, the drive shaft 182 rotates about its longitudinal axis to rotate the auger 166 about its longitudinal axis. Accordingly, the motor assembly 130 translates the rotary motion of the motor 176 to rotary motion of the auger 166. A push button 190 or other suitable wired or wireless means may be used to activate the motor 176. Moreover, one of ordinary skill can appreciate that any suitable power may be used to activate the motor 176. For instance, a suitable battery may be integrated into the mixing pack 120 for powering the motor 176. In the alternative, an inlet/outlet receptacle may be provided on the mixing pack 120 for connecting the motor 176 to a separate power source. Accordingly, the present disclosure should not be seen as limiting.

Figure 9:
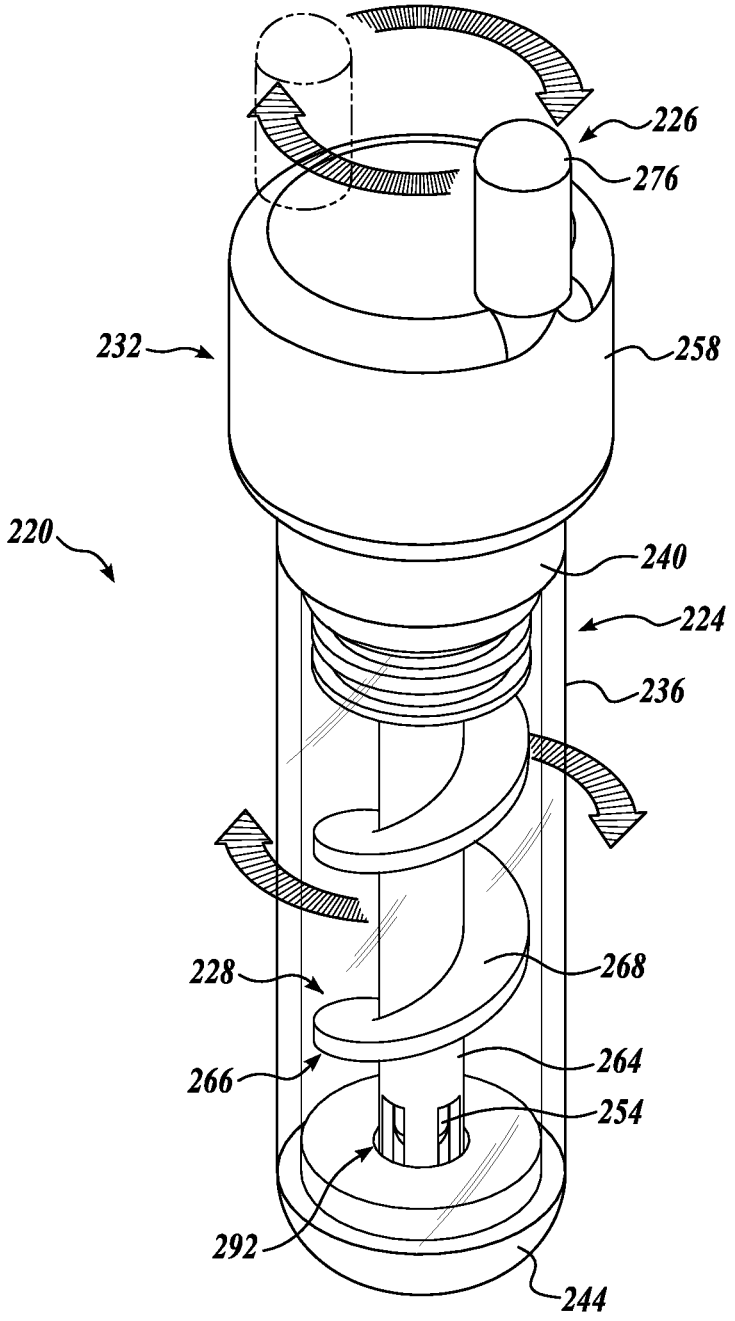
FIG. 9 is an isometric view of a multi-phase cosmetic composition mixing pack formed in accordance with a third exemplary embodiment of the present disclosure.
Figure 10:
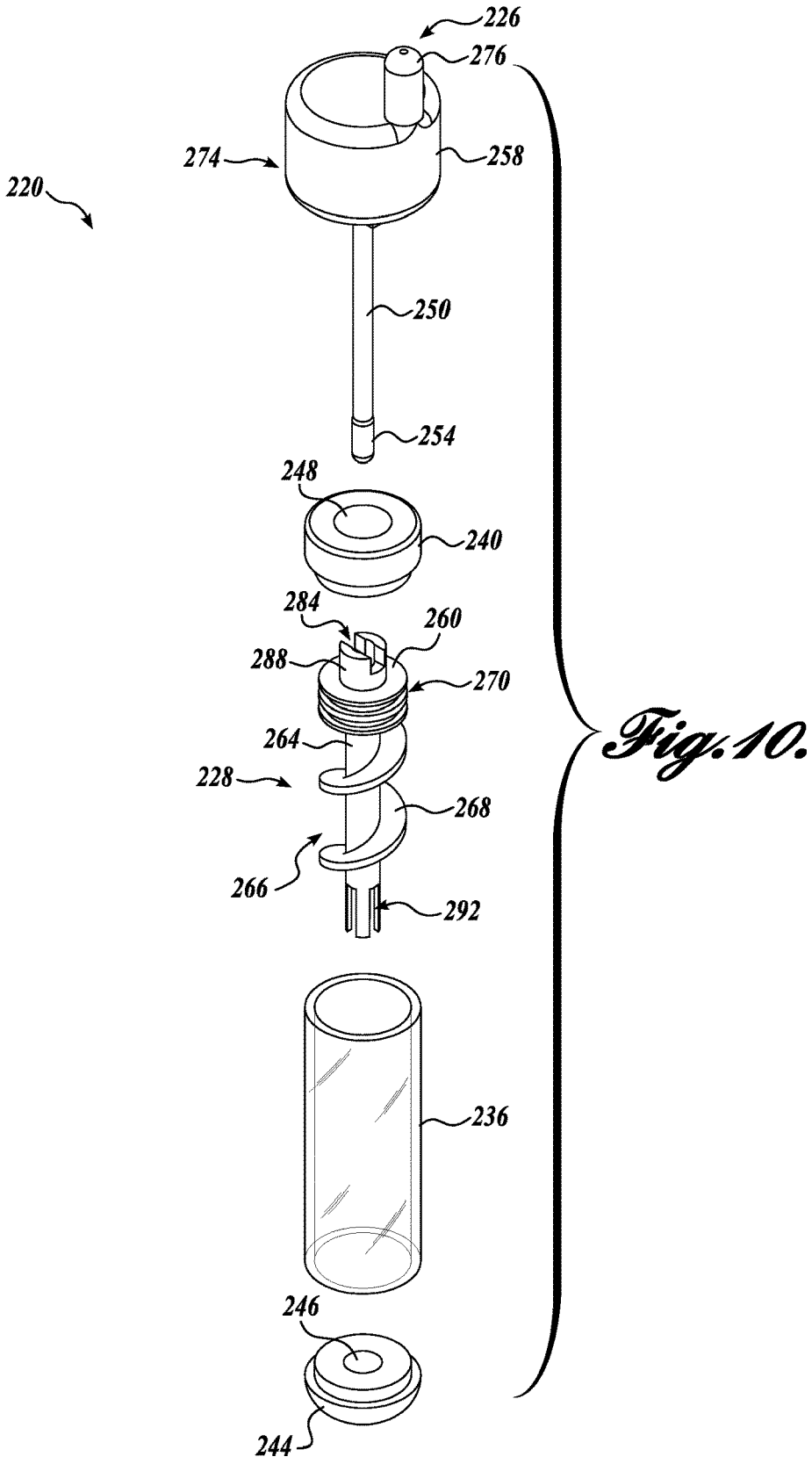
FIG. 10 is a top isometric exploded view of the multi-phase cosmetic composition mixing pack of FIG. 9.
Figure 11:
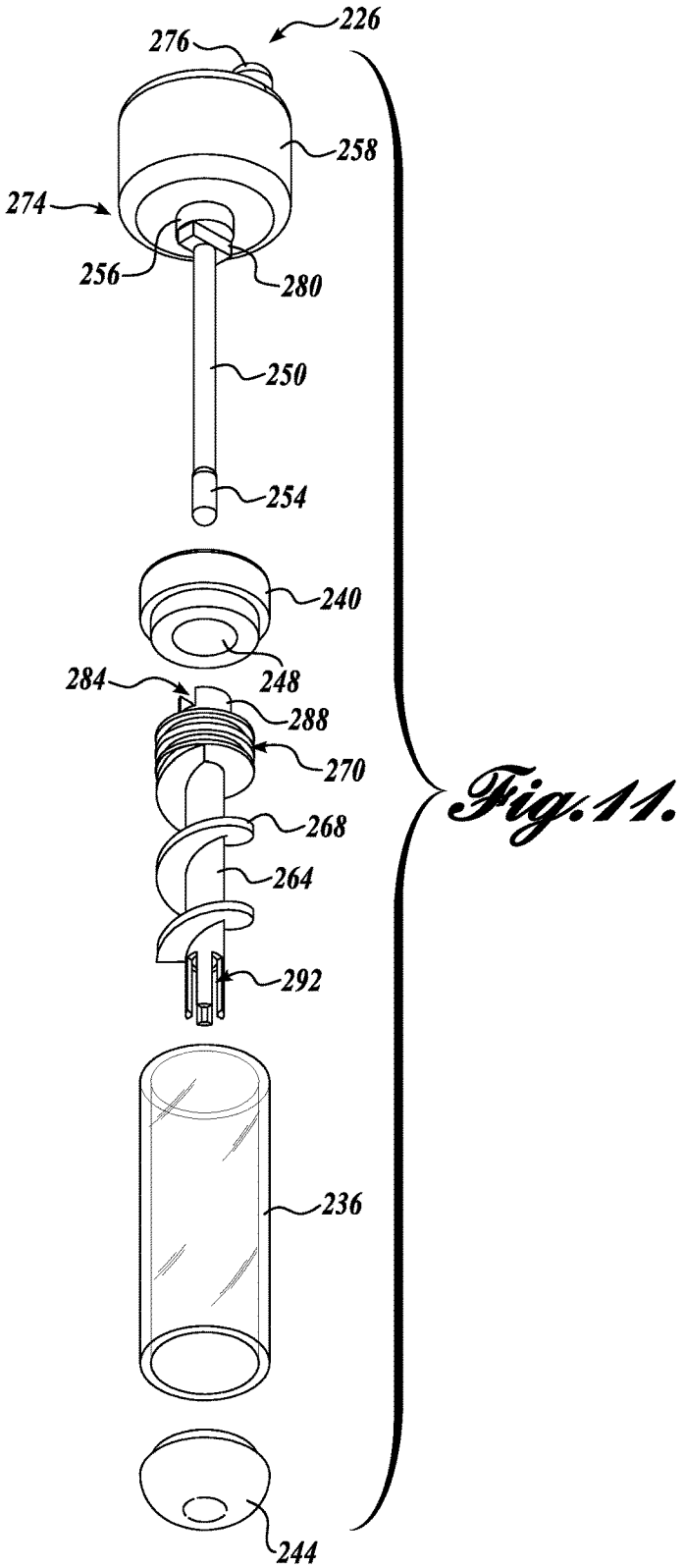
FIG. 11 is a bottom isometric exploded view of the multi-phase cosmetic composition mixing pack of FIG. 9.

Referring now to FIG. 9, a third exemplary embodiment of a multi-phase cosmetic composition mixing pack 220 ("mixing pack 220") suitable for mixing a multi-phase cosmetic composition (not shown) so that the immiscible components are temporarily miscible will now be described. The mixing pack 220 is substantially similar in many respects to the mixing pack 20 shown and described above with reference to FIGS. 1-8. As such, like parts have been numbered with like references numerals in the '200 series. Aspects of the mixing pack 220 that are substantially identical to the mixing pack 20 will not be described in great detail.

The mixing pack 220 generally includes a container 224 for holding the multi-phase cosmetic composition, a mixing assembly 228 for mixing the multi-phase cosmetic composition, an actuation assembly 226 for actuating the mixing assembly 228, and an applicator 232 for applying the temporarily miscible components of the multi-phase cosmetic composition to a keratinous material.

Referring additionally to FIGS. 10, 11, 12*a*, and 12*b*, the container 224 has a container body 236 with first and second open ends that are enclosed by first and second (or top and bottom) end caps 240 and 244. The first (or top) end cap 240 encloses and seals the first, top open end of the container body 236 and provides an interface between the applicator 232 and the interior of the container 224. The first end cap 240 includes a central, axial opening 248 that is sized to allow a stem 250 and applicator tip 254 of the applicator 232 to pass therethrough.

The central opening 248 is also sized to rotatably receive an end cap protrusion 256 extending from a bottom surface of the cap 258 of the applicator 232. A slight friction fit may be defined between the end cap protrusion 256 and the first end cap 240 to secure the cap 258 of the applicator 232 to the container 224 when not in use. However, the friction fit is sufficiently minimal such that the end cap protrusion 256 may rotate within the central opening 248 when the actuation assembly 226 is actuated. In the alternative, the diameter of the central opening 248 may be larger than the diameter of the end cap protrusion 256 such that no friction fit is defined therebetween. In such an alternative configuration, the cap 258 of the applicator 232 may be temporarily secured to the container 224 through other means.

The second (or bottom) end cap 244 is substantially identical to the second end cap 44 described above, except that it includes a central axial cavity 246 in its upper surface for receiving a portion of the mixing assembly 228. The first and second end caps 240 and 244 may be press-fit or otherwise secured to or within the open ends of the container body 236 in any suitable manner. In the alternative, the container 224 may instead be integrally formed with the end caps. Moreover, any other suitable end caps, mating configurations, and/or container shapes may instead be used for the intended application.

The container 224 is suitably sized and shaped to enclose the mixing assembly 228 (or the mixing assembly 228 is sized to fit within the container 224) such that when the mixing assembly 228 is actuated, the multi-phase cosmetic composition contained within the container 224 is appropriately mixed.

The mixing assembly 228 includes an auger 266 defined by at least one helix extending from a lower surface of a motion transfer plate 260 down around a central longitudinal, axial auger core 264. The auger core 264 is hollow along its length to receive the stem 250 and applicator tip 254 of the applicator 232 when the mixing pack 220 is assembled. The distal end of the auger core 264 is rotatably receivable within the central axial cavity 246 in the second end cap 244 to define a second point of rotation for the auger 266. A slotted portion 292 is also defined at the distal end of the auger core 264 for allowing the multi-phase cosmetic composition to reach the applicator tip 254. It should be appreciated that the mixing assembly 228 may instead include no auger core 264, with the at least one helix instead extending between the motion transfer plate 260 and a base plate, similar to the embodiment shown in FIGS. 1-4*b*. As yet another alternative, the auger core 264 may include openings along its length (rather than a slotted portion 292) for allowing the multi-phase cosmetic composition to reach the applicator tip 254. Thus, any suitable design may be used.

The motion transfer plate 260 may include an annular groove section 270 having one or more annular grooves extending around the circumference of the plate 260. Each annular groove of the annular groove section 270 is configured to receive an annular seal, such as an O-ring (not shown), for sealing between the motion transfer plate 160 and the container body 236.

The nominal diameter of the auger 266 defined by the at least one helix is substantially the same size as an interior diameter of the container body 236. As such, the auger 266 reaches substantially all the contents of the container 224 when actuated to ensure substantially even mixing of the immiscible components. In the depicted embodiment, the mixing assembly 228 includes a first helix 268 of a predefined geometry. The helix geometry of the auger 266 has a lower pitch than the helix geometry of the auger 66 described above. Moreover, the auger 266 includes only a single helix as opposed to a double helix. The auger 266 may be suitable for a low viscosity multi-phase cosmetic composition, whereas the auger 66 may be suitable for a higher viscosity multi-phase cosmetic composition. As noted above, any suitable helix geometry (pitch, diameter, shape, etc.) may be used for the intended application.

The auger 266 is actuated by the actuation assembly 226 to mix the multi-phase cosmetic composition. In this third exemplary embodiment of a mixing pack 220, the actuation assembly is defined by a hand crank assembly 274 integrally formed within the cap 258 of the applicator 232. The auger 266 is actuated, or rotated about its central longitudinal axis, through the rotary motion of the hand crank assembly 274.

The hand crank assembly 274 includes a crank handle 276 extending from an upper surface of the cap 258. The crank handle 276 is offset from the center of the cap 258 such that a torque may be applied by hand to rotate the cap 258 about its central axis. The rotation of the cap 258 is translated to the mixing assembly 228 through a first point of rotation defined by a crank block 280 secured to a lower surface of the end cap protrusion 256. The crank block 280 is polygonal in shape, such as rectangular, and is received within a correspondingly shaped slot 284 in a coupling 288 extending from an upper surface of the motion transfer plate 260. The coupling 288 is substantially circular in cross-sectional shape and is receivable and rotatable within the central opening 248 of the motion transfer plate 260.

Figure 12A:
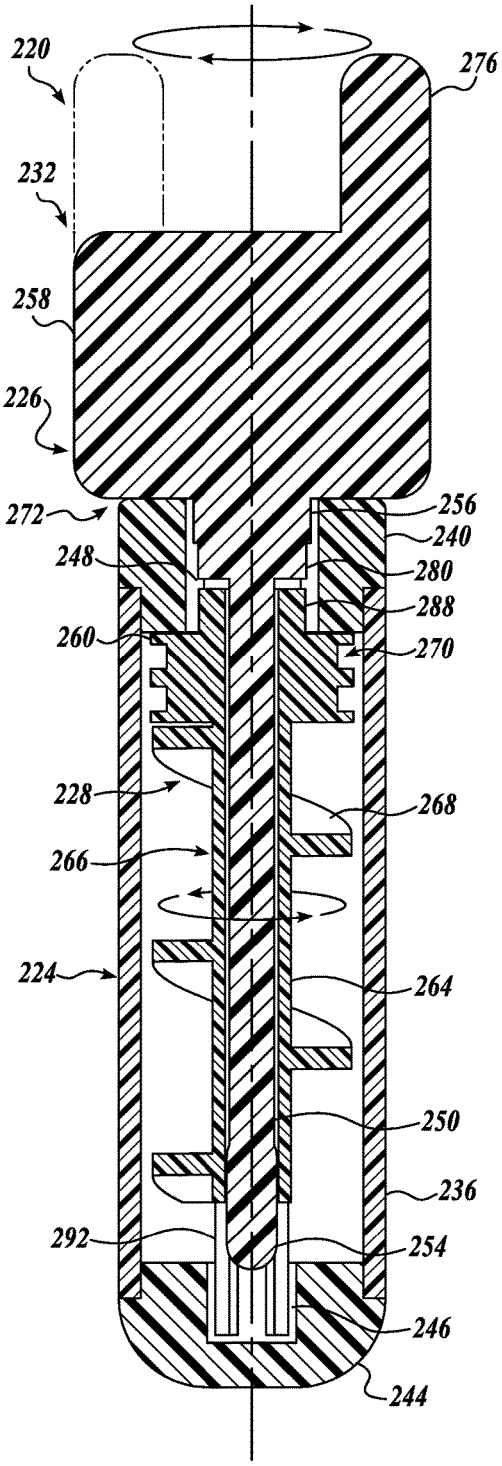
FIG. 12*a* is a partial cross-sectional view of the multi-phase cosmetic composition mixing pack of FIG. 9, wherein a portion of the mixing pack is shown in a first position.
Figure 12B:
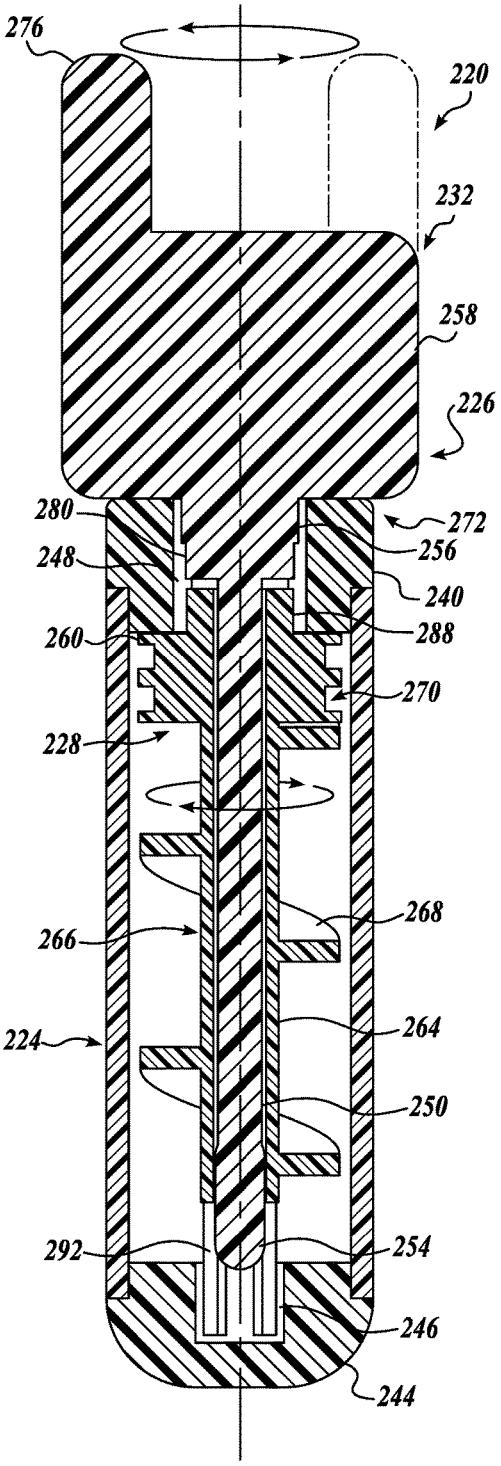
FIG. 12*b* is a partial cross-sectional view of the multi-phase cosmetic composition mixing pack of FIG. 9, wherein a portion of the mixing pack is shown in a second position.

As can best be seen by referring to FIGS. 12*a* and 12*b*, the hand crank handle 276 is rimmed to rotate the cap 258 about its central axis. In turn, the crank block 280 rotates about the central axis of the cap 258, which rotates the mixing assembly 228 about its central longitudinal axis (which is in substantial alignment with the central axis of the cap 258) through the interaction of the crank block 280 and the coupling 288. Accordingly, the hand crank assembly 274 translates the rotary motion of the cap 258 to rotary motion of the auger 266. The auger 266 rotates to mix the immiscible components of the multi-phase cosmetic composition. When the immiscible components are temporarily miscible, the applicator 232 may be used to apply the composition to a keratinous material.

It can be appreciated from the description and illustrations set forth herein that any suitable mixing assembly may be used to suitably mix the immiscible components of the multi-phase cosmetic composition such that they are temporarily miscible for application to a keratinous material. For instance, in lieu of an auger, another suitable mixing assembly may be used, such as a central core extending along the length of the container that includes a plurality of uniform or irregular protrusions extending radially therefrom. In such an embodiment, the actuator assembly may be used to rotate the central core containing protrusions. As yet another alternative, the mixing assembly may comprise protrusions extending from the interior surface of the container that extend toward the center of the container. In such an embodiment, the container may be rotated or otherwise moved by the actuator assembly. In yet another alternative embodiment, a container having internal radial protrusions may be used in combination with an auger/core, with one or more of the container and the auger/core movable by the actuator assembly. It should be appreciated that any suitable mixing assembly that can be actuated by one or more movements, buttons, switches, etc., may be used.

It should also be appreciated that certain features of each embodiment may be eliminated or replaced with other features shown in described in other embodiments. For instance, in some embodiments, the stem and applicator tip may be removed. Such an embodiment may be suitable for applications such as foundation, lotion, etc., where application is done with a user's finger tips, a cotton swab, etc. Thus, the claimed subject matter is not limited to the mixing assemblies, actuator assemblies, applicators, or the precise mixing pack embodiments disclosed herein.

The mixing assemblies described above may also be comprised of certain materials, surface treatments, surface features, coatings, etc., to improve the interaction of the mixing assembly with the multi-phase cosmetic composition. For instance, at least a portion of the augers 66, 166, and 266, or another portion of the mixing assembly, may be treated with a suitable material that increases wetting of an aqueous phase of the multi-phase cosmetic composition on the surface of the auger. In one embodiment, one or more surfaces of the augers 66, 166, and 266 may be comprised of at least one hydrophilic or a superhydrophilic surface. The auger may also be treated to increase wetting of a silicone phase of the multi-phase cosmetic composition on the surface of the auger. For instance, in an embodiment, one or more surfaces of the augers 66, 166, and 266 may be comprised of at least one hydrophobic or superhydrophobic surface.

The wettability of a region can be determined using various technologies and methodologies including contact angle methods, the Goniometer method, the Whilemy method, or the Sessile drop technique. Wetting is a process by which a liquid interacts with a solid. Wettability (the degree of wetting) is determined by a force balance between adhesive and cohesive force and is often characterized by a contact angle. The contact angle is the angle made by the intersection of the liquid/solid interface and the liquid/air interface. Alternatively, it is the angle between a solid sample's surface and the tangent of a droplet's ovate shape at the edge of the droplet. Contact angle measurements provide a measure of interfacial energies and conveys direct information regarding how hydrophilic or hydrophobic a surface is. For example, superhydrophilic surfaces have contact angles less than about 5°, hydrophilic surfaces have contact angles less than about 90°, hydrophobic surfaces have contact angles greater than about 90°, and superhydrophobic surfaces have contact angles greater than about 150°. (see, e.g. U.S. Publication No. 2013/0131575, entitled "Systems, Devices, and Methods Including Infection-Fighting and Monitoring Shunts," the disclosure of which is hereby incorporated by reference herein in its entirety).

As a specific example, the augers may be treated with one or more hydrophilic coatings, including polyvinylpyrolidone (PVP), polyurethanes, polyacrylic acid (PAA), polyethylene oxide (PEO), and/or polysaccharides. In the alternative or in addition thereto, the augers may be treated to increase the surface energy of the auger, such as with a plasma treatment.

In another example, the auger may be treated with one or more hydrophobic or superhydrophobic coatings such as manganese oxide polystyrene (MnO2/PS) nano-composite, zinc oxide polystyrene (ZnO/PS) nano-composite, precipitated calcium carbonate[3], carbon nano-tube structures, and/or silica nano-coating.

Additional non-limiting examples of materials that affect wettability of a surface include, but are not limited to, amphoteric surfactants, anionic surfactants, cationic surfactants, non-ionic surfactants, and the like.

In the alternative or in addition thereto, the augers may comprise one or more nanostructures, microstructures, hierarchical structures, and the like that affect wettability of a surface. Non-limiting examples of nanostructures, microstructures, hierarchical structures, and the like include nanopatterned, micropatterned, and the like polymeric coatings. Specific examples include patterned silicon surface, perfluorodecyltriethyoxysilane (PFDTES) coatings, poly (methyl methacrylate) (PMMA) patterned structures, polystyrene (PS) (hydrophobic) patterned structures, and the like.

The above-noted treatments may be applied to any suitable portion of the auger. For instance, if an auger includes more than one helix, such as the auger 66 shown in FIGS. 1-3, the first helix 68 may be treated with a hydrophilic coating or similar, and the second helix 72 may be treated with a hydrophobic coating or similar. As yet another alternative, a first surface of the helix may be treated with a hydrophilic coating or similar, and a second surface of the helix opposite the first surface may be treated with a hydrophobic coating or similar. In another alternative configuration, the auger may be formed from a hydrophilic material or similar, and a hydrophobic material or coating may be overmolded or treated on one side of the helix. In such configurations, the auger (or the helix) would have at least two different surface properties.

It should also be appreciated that the surface properties of the auger may be defined in any suitable manner. For instance, the auger itself may be made from a hydrophilic material or hydrophobic material. In the alternative, the auger may be made from any suitable material, and one or more surfaces of the auger may be treated with a hydrophilic material or hydrophobic material. Moreover, the auger may be treated, coated, sprayed, etc., with a suitable material in any suitable manner. In addition, the auger may be textured or patterned in a suitable manner.

Thus, while illustrative embodiments have been illustrated and described, it will be appreciated that various changes can be made therein without departing from the spirit and scope of the invention.

The invention claimed is:

1. A multi-phase cosmetic composition mixing pack for mixing immiscible components of a multi-phase cosmetic composition such that they are temporarily miscible, the mixing pack comprising:

(a) a container for holding the multi-phase cosmetic composition, the container having a first open end;

(b) a mixing assembly disposed within the container for mixing immiscible components of the multi-phase cosmetic composition such that they are temporarily miscible, wherein the mixing assembly is defined by an auger having a length; and (c) an actuator assembly for actuating the auger, the actuator assembly comprising:

(i) a stem receivable within the first open end of the container, the stem having a cam surface extending along at least a portion of a length of the stem, wherein the stem is configured to extend within the auger lengthwise along at least a portion of the length of the auger; and (ii) a cam follower surface defined on the mixing assembly, wherein linear reciprocating motion of the stem causes rotation of the auger.

2. The mixing pack of claim 1, further comprising an applicator for applying the temporarily miscible components of the multi-phase cosmetic composition to a keratinous material, the applicator comprising an applicator portion on a distal end of the stem.

3. The mixing pack of claim 1, wherein the reciprocating linear motion of the stem causes the auger to oscillate.

4. The mixing pack of claim 3, wherein the stem interfaces the auger through a motion transfer plate, the motion transfer plate having the at least one cam follower surface that is engageable with the at least one cam surface as the stem is reciprocated.

5. The mixing pack of claim 4, wherein the at least one cam follower surface of the motion transfer plate is defined by an opening in the motion transfer plate, and wherein the stem is receivable within the opening in the motion transfer plate.

6. The mixing pack of claim 5, wherein the at least one cam surface extends along at least a portion of a length of the stem in a twisted manner.

7. The mixing pack of claim 1, wherein the auger includes at least one helix extending between first and second points of rotation.

8. The mixing pack of claim 1, wherein the auger is comprised of at least one of a hydrophilic material and a hydrophobic material.

9. The mixing pack of claim 8, wherein the hydrophilic material is chosen from a group consisting of polyvinylpyrolidone (PVP), polyurethanes, polyacrylic acid (PAA), polyethylene oxide (PEO), polysaccharides, and any combination thereof.

10. The mixing pack of claim 8, wherein the hydrophobic material is chosen from a group consisting of manganese oxide polystyrene (MnO2/PS) nano-composite, zinc oxide polystyrene (ZnO/PS) nano-composite, precipitated calcium carbonate[3], carbon nano-tube structures, silica nano-coating, and any combination thereof.

11. The mixing pack of claim 8, wherein the mixing assembly is treated with a plasma treatment.

12. The mixing pack of claim 8, wherein the mixing assembly has a patterned surface to increase wettability.

13. A multi-phase cosmetic composition mixing pack for mixing immiscible components of a multi-phase cosmetic composition such that they are temporarily miscible, the mixing pack comprising:

(a) a container for holding the multi-phase cosmetic composition, the container having a first open end;

(b) a mixing assembly disposed within the container for mixing immiscible components of the multi-phase cosmetic composition such that they are temporarily miscible, the mixing assembly comprising an auger having a length and defined by at least one helix extending between first and second points of rotation, wherein the auger is comprised of at least one of a hydrophilic material and a hydrophobic material; and (c) an actuator assembly for actuating the mixing assembly, the actuator assembly comprising:

(i) a stem receivable within the first open end of the container, the stem having a cam surface extending along at least a portion of a length of the stem, wherein the stem is configured to extend through the at least one helix lengthwise along at least a portion of the length of the auger; and (ii) a cam follower surface defined on the mixing assembly, wherein linear reciprocating motion of the stem causes rotation of the auger.

14. The mixing pack of claim 13, wherein the hydrophilic material is chosen from a group consisting of polyvinylpyrolidone (PVP), polyurethanes, polyacrylic acid (PAA), polyethylene oxide (PEO), polysaccharides, and any combination thereof.

15. The mixing pack of claim 13, wherein the hydrophobic material is chosen from a group consisting of manganese oxide polystyrene (MnO2/PS) nano-composite, zinc oxide polystyrene (ZnO/PS) nano-composite, precipitated calcium carbonate[3], carbon nano-tube structures, silica nano-coating, and any combination thereof.

16. The mixing pack of claim 13, wherein the auger is treated with a plasma treatment.

17. The mixing pack of claim 13, wherein the at least one helix of the auger includes first and second opposing surfaces, wherein the first surface is comprised of a hydrophilic material and the second surface is comprised of a hydrophobic material.

18. The mixing pack of claim 13, wherein the auger includes a first helix and a second helix, wherein the first helix is comprised of a hydrophilic material and the second helix is comprised of a hydrophobic material.

19. A method for mixing a multi-phase cosmetic composition having immiscible components such that they are temporarily miscible, the method comprising:

(a) providing a mixing pack, comprising:

(i) a container for holding the multi-phase cosmetic composition, the container having a first open end;

(ii) a mixing assembly disposed within the container, wherein the mixing assembly is defined by an auger having a length; and (iii) an actuator assembly for actuating the mixing assembly, the actuator assembly comprising:

a stem receivable within the first open end of the container, the stem having a cam surface extending along at least a portion of a length of the stem and the stem configured to extend within the auger lengthwise along at least a portion of the length of the auger; and a cam follower surface defined on the mixing assembly; and (b) reciprocating the stem linearly within the auger to rotate the auger to mix the immiscible components of the multi-phase cosmetic composition such that they are temporarily miscible.

* * * * *